United States Patent [19]

Stephenson et al.

[11] Patent Number: 5,053,790

[45] Date of Patent: Oct. 1, 1991

[54] PARASITIC RESISTANCE COMPENSATION FOR THERMAL PRINTERS

[75] Inventors: Stanley W. Stephenson, Spencerport; Young No, Pittsford; David A. Johnson, Rochester, all of N.Y.

[73] Assignee: Eastman Kodak Company, Rochester, N.Y.

[21] Appl. No.: 547,353

[22] Filed: Jul. 2, 1990

[51] Int. Cl.[5] ..... B41J 2/325

[52] U.S. Cl. ..... 346/76 PH; 400/120

[58] Field of Search ..... 346/76 PH; 400/120

[56] References Cited

U.S. PATENT DOCUMENTS

| | | | |
|---|---|---|---|
| 4,322,733 | 3/1982 | Moriguchi et al. | 346/76 PH |
| 4,404,567 | 9/1983 | Katsuragi | 346/76 PH |
| 4,434,356 | 2/1984 | Craig et al. | 219/216 |
| 4,514,737 | 4/1988 | Suzuki | 346/76 PH |
| 4,531,134 | 7/1985 | Horlander | 346/76 PH |
| 4,574,293 | 3/1986 | Inui et al. | 364/76 PH |
| 4,724,336 | 2/1988 | Ichikawa et al. | 307/150 |
| 4,736,089 | 4/1988 | Hair et al. | 219/216 |
| 4,746,931 | 5/1988 | Okuda | 346/76 PH |
| 4,774,528 | 9/1988 | Kato | 346/76 PH |
| 4,783,668 | 11/1988 | Takahashi et al. | 346/76 PH |
| 4,814,787 | 3/1989 | Doi | 346/1.1 |
| 4,816,843 | 3/1989 | Sasaki | 346/76 PH |
| 4,827,279 | 5/1989 | Lubinsky et al. | 346/1.1 |
| 4,827,281 | 5/1989 | Lubinsku et al. | 346/1.1 |

FOREIGN PATENT DOCUMENTS

| | | | |
|---|---|---|---|
| 0014787 | 1/1983 | Japan | 346/76 PH |
| 0143979 | 7/1985 | Japan | 346/76 PH |
| 147357 | 8/1985 | Japan . | |
| 0253562 | 12/1985 | Japan | 346/76 PH |
| 0267164 | 11/1987 | Japan | 346/76 PH |

*Primary Examiner*—Benjamin R. Fuller
*Assistant Examiner*—Huan Tran
*Attorney, Agent, or Firm*—Raymond L. Owens

[57] ABSTRACT

A thermal printhead having a plurality of resistive heat elements receives electrical current from a power supply. The current is directed to selected ones of a plurality of heat elements in response to a sequence of data bits corresponding to the image to be recorded. The number of selected heat elements is determined by the current to the printhead or by counting the number of data bits and a signal representative of the number of selected heat elements is produced. The voltage coupled to the printhead is adjusted responsive to the sensed number of selected heat elements to maintain a prescribed voltage across the selected heat elements that is substantially constant independent of the number of selected heat elements.

20 Claims, 8 Drawing Sheets

310
748
D/A CONVERTER
746
LATCH REGISTER
LATCH
744
M BIT COUNTER
RESET
742
740
DELAY
750
752
754
756
VOLTAGE REGULATOR
201
POWER SUPPLY
+
-
224
203
226
205
220
222
26
207-N
209-N
211-N
207-2
209-2
211-2
207-1
209-1
211-1
SHIFT REGISTER
213
228
229
232
230
EN
LA
DATA
CLK
732
730
731

PARASITIC RESISTANCE COMPENSATION FOR THERMAL PRINTERS

FIELD OF THE INVENTION

The invention relates to thermal printers and more particularly to circuitry for supplying energy to thermal printhead heat elements.

BACKGROUND OF THE INVENTION

As is well known in the art, a thermal printhead utilizes a row of closely spaced resistive heat generating elements which are selectively energized to record data in hard copy form. The data may comprise stored digital information related to text, bar codes or graphic images. In operation, the thermal printhead heat elements receive energy from a power supply through driver circuits in response to the stored digital information. The heat from each energized element may be applied directly to thermal sensitive material or may be applied to a dye coated web to cause transfer of the dye by diffusion to paper or other receiver material.

The heat developed in each resistive heat element is a function of a number of factors including the voltage applied to the element, the thermal state of the element and the thermal states of the surrounding elements. For example, deviations in voltage across the resistive heat element cause variations in print density that are particularly noticeable in continuous tone graphical and pictorial images. Many different techniques have been devised to control the factors which determine the print quality. U.S. Pat. No. 4,736,089 (issued to Victor D. Hair on Apr. 5, 1988) discloses a switching regulator for a thermal printhead in which the printhead temperature is sensed by a voltage generating diode incorporated in the printhead. The diode voltage is fed back to control the reference voltage of a switching regulator power supply that provides power to the printhead.

U.S. Pat. No. 4,724,336 (issued to Takashu Ichikawa et al. on Feb. 9, 1988) discloses a power circuit for a thermal printhead in which the head resistance values are stored and the reference voltage of printhead power supply is selected from memory for each printhead element resistance. In this way, compensation is provided for the variations in the individual printhead element resistances. The arrangement, however, requires that the resistances of individual printhead resistances be measured and does not compensate for voltage or temperature variations.

U.S. Pat. No. 4,531,134 (issued to Frank J. Horlander on July 23, 1985) discloses a regulated voltage circuit for a thermal printhead in which the voltage at one electrode of each heat element is monitored and the lowest voltage is fed back to determine the current in a resistive ribbon printer via a differential amplifier control circuit. In this way, the energy to the heat elements is maintained above a predetermined minimum. U.S. Pat. No. 4,434,356 (issued to Timothy P. Craig et al. on Feb. 28, 1984) discloses a current drive circuit for a thermal ribbon printer in which the voltage at each ribbon resistance is monitored and used as a control input to a voltage regulator circuit that produces a head resistance drive voltage. In order to utilize either of these techniques in a multiple heat element printhead, it is necessary to access the electrodes of individual heat elements to obtain the required control voltage. None of the aforementioned patents solves the problem of voltage variations across printhead heat elements caused by internal printhead wiring resistances.

Many thermal printheads incorporate driver and other circuitry that control printhead operation so that it is difficult to obtain access to the electrodes of individual printhead resistive heating elements. It is relatively easy, however, to determine the voltage at the terminals of the printhead connectors. But the voltage across the printhead includes parasitic drops across power supply lines, interconnections and other wiring internal to the printhead. These parasitic voltage drops are proportional to the number of heat elements turned on for a print line. As a result, the parasitic voltage drops vary considerably as the number of selected heating elements changes. The varying heat element voltage produces noticeable variations in the density of the imprinted picture elements or pixels.

U.S. Pat. No. 4,774,528 (issued to Nobuhisa Kato on Sept. 27, 1988) discloses thermal recording apparatus in which the black density of pixels to be recorded by thermal recording elements are compared to reference density levels. A counter accumulates a value representing the number of pixels having density levels in certain ranges as a result of the comparison. The counter value is used to adjust the pulse width of energizing pulses to compensate for voltage fluctuations at the printhead heat elements due to the number of recording elements energized at one time. Adjustment of energizing pulse widths, however, is complex and does not yield sufficiently precise energy control to compensate for heat element voltage variations.

It is desirable to provide a relatively simple technique to accurately control the voltages across printhead heating elements without requiring access to the individual printhead elements.

SUMMARY OF THE INVENTION

The present invention is directed to thermal printing apparatus in which a thermal printhead receives electrical current from a voltage source and directs the current to selected ones of a plurality of heat elements under control of a sequence of data bits. The number of selected heat elements is sensed external to the printhead and the voltage coupled to the printhead is controlled external to the printhead responsive to the sensed power demand of the printhead elements to maintain a prescribed voltage across the selected heat elements substantially constant independent of the number of selected heat elements.

In accordance with one aspect of the invention, the number of selected heat elements is sensed by generating a signal representative of the current coupled from the voltage source to the printhead. The voltage coupled to the printhead is modified in response to the signal representative of the current coupled from the voltage source to the selected heat elements to maintain the prescribed voltage across the selected heat elements substantially constant independent of the number of selected heat elements.

In an illustrative embodiment of the invention, a thermal printer includes a printhead comprising first and second terminals and a plurality of resistive heat elements. Each resistive heat element has first and second electrodes. A voltage source having positive and negative terminals supplies current to the printhead. A first bus couples the positive terminal of the voltage source to the first terminal of the printhead. The first terminal of the printhead is coupled to the first electrode of each resistive heat element. Data supplied to printhead selectively couples the second electrodes of the resistive heat elements to the second terminal of the printhead. A second bus is connected to the negative terminal of the voltage source and a resistive element coupled between the second terminal of the printhead and the second bus. The resistive element senses the current to the printhead which is representative of the number of selected resistive heat elements. A semiconductor device coupled to the second bus adjusts the voltage across the first and second terminals of the printhead to maintain a substantially constant voltage across the first and second electrodes of the selected resistive heat elements independent of the number of selected heat elements.

Viewed from another aspect, the present invention is directed to thermal printing apparatus comprising a printhead comprising a plurality of heat elements coupled between first and second terminals thereof, power supply means coupled to the first and second terminals for supplying current to the heat elements, control means coupled to the heating elements for selecting which of the heating elements receives current supplied by the power supply means, means for sensing the a power demand of the printhead, and means responsive to the power demand of the printhead for controlling the voltage coupled to the first and second terminals of the printhead so as to maintain a prescribed essentially equal voltage across each of the selected heat elements.

The invention will be better understood from the following more detailed description taken with the accompanying drawings and claims.

DETAILED DESCRIPTION

Figure 1:
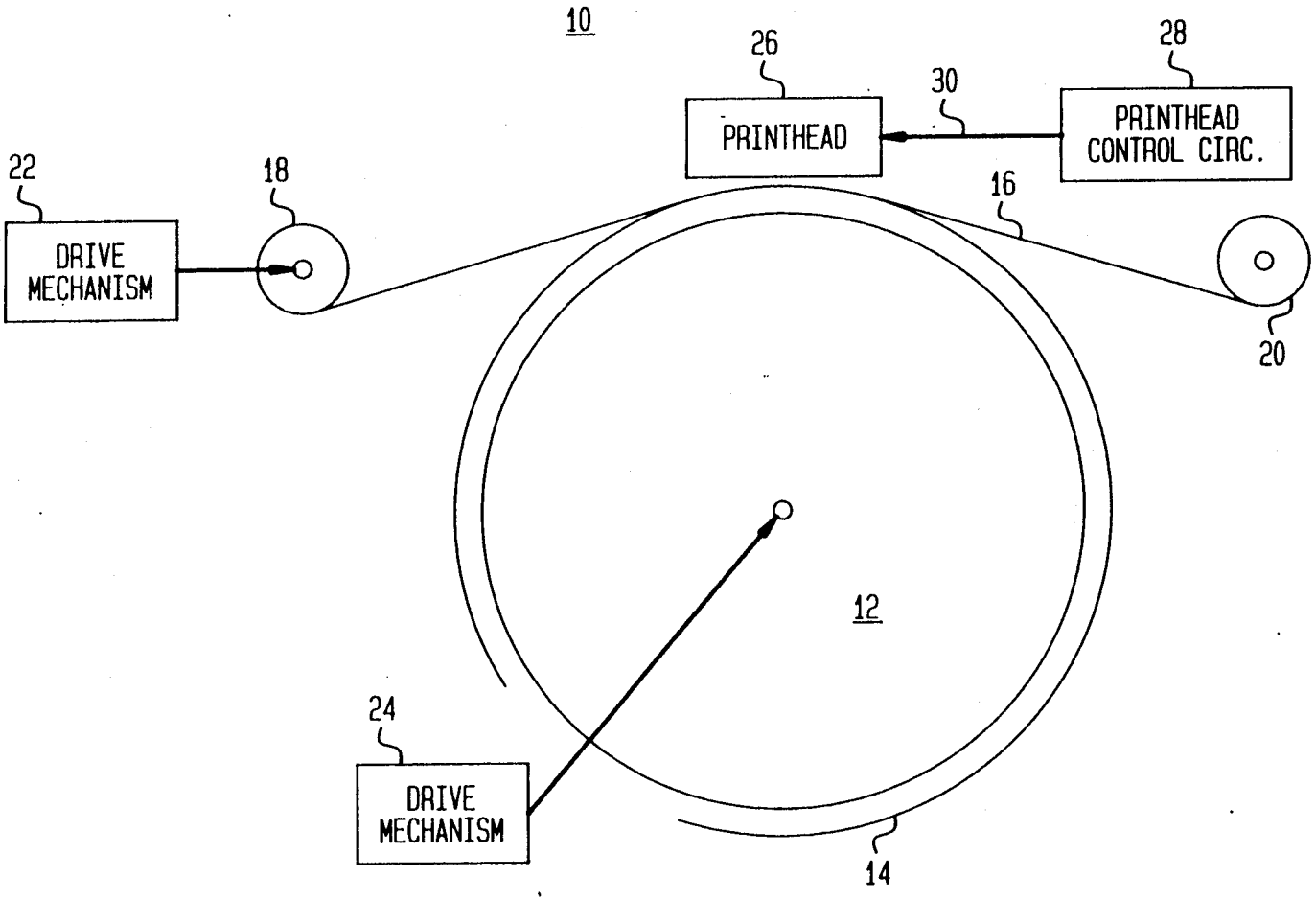
FIG. 1 is a schematic and block diagram of a thermal printer in which the invention may be employed.

Referring now to FIG. 1, there is shown a dye transfer thermal printer apparatus 10 in which the present invention may be employed. The thermal printer apparatus 10 comprises a rotatable drum 12, a receiver member 14 in the form of a sheet, drive mechanisms 22 and 24, a carrier member 16 in the form of a web, a supply roller 20, a take-up roller 18, a thermal printhead 26 and a printhead control circuit 28. The printhead control circuit comprises a power supply, an image data source and a control pulse generator which are all not shown. The drive mechanism 22 comprises a motor (not shown) mechanically coupled to the take-up roller 18. The carrier member 16 is disposed between the supply roller 20 and the take-up roller 18 and passes between the printhead 26 and the receiver member 14. The drive mechanism 24 comprises a motor (not shown) that is mechanically coupled to the rotatable drum 12. The receiver member 14 is secured to the drum 12. The thermal printhead 26 comprises a plurality of resistive heat elements (not shown). The printhead control circuit 28 is electrically coupled via conductors 30 to the thermal printhead 26.

The printhead 26 is pivotally mounted and its resistive heat elements normally press against the carrier member web 16. Drive mechanisms 22 and 24 cause the take-up roller 18 and the drum 12 to rotate and thereby advance the carrier member web 16 and the receiver member 14. In operation, the heat elements of the printhead 26 are selectively energized in accordance with data from the printhead control circuit 28 as the drum 12 and the take-up roller 18 are continuously advanced. As a result, the image defined by the data from the printhead control circuit 28 is placed on the receiver member 14. The arrangement of FIG. 1 is similar to that described and illustrated in U.S. Pat. No. 4,786,917 (issued to Edward A. Hauschil et al. on Nov. 22, 1988).

Figure 2:
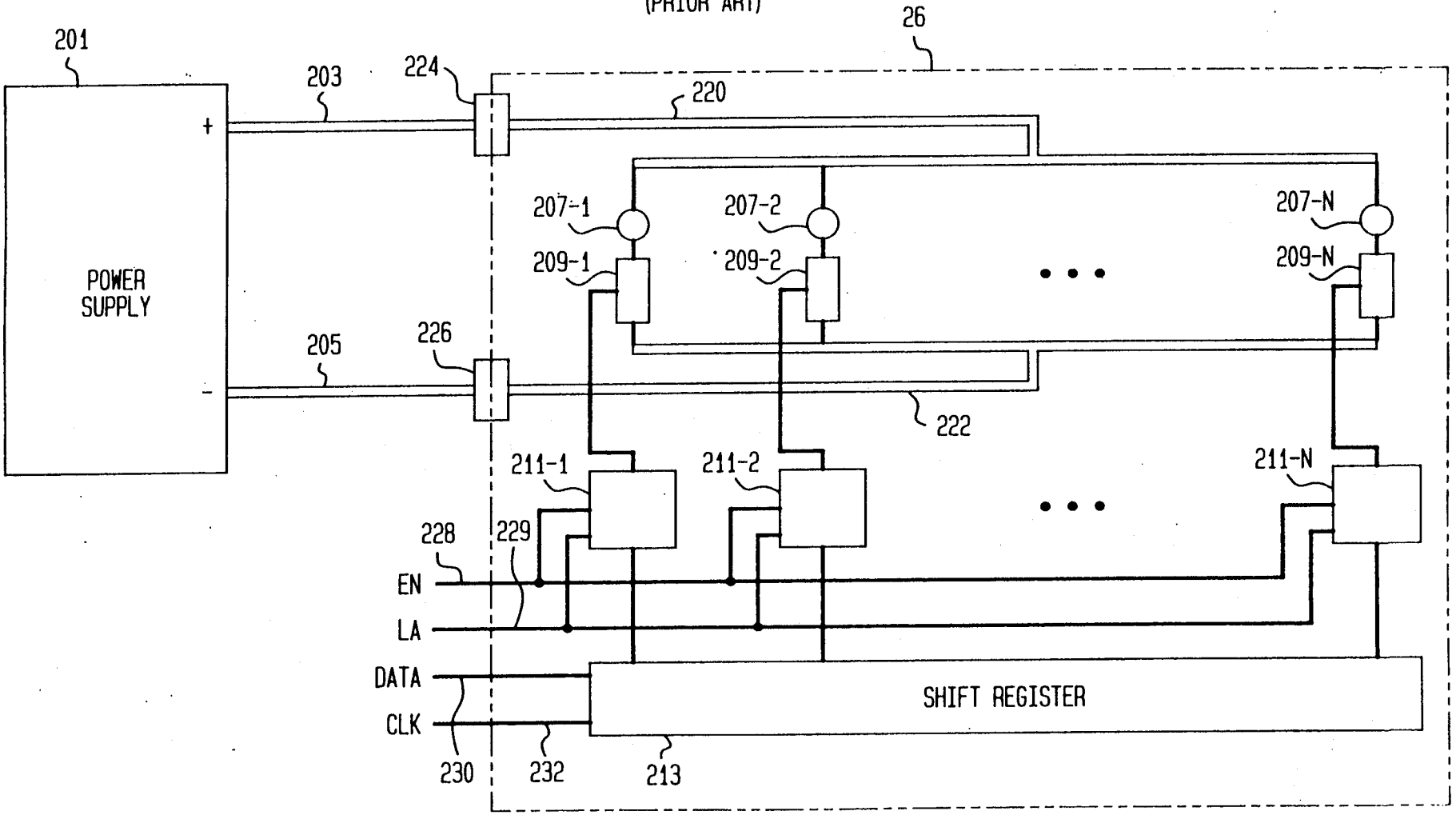
FIG. 2 (PRIOR ART)
FIG. 2 is a block diagram of a thermal printhead circuit in accordance with the prior art.

Referring now to FIG. 2, there is shown a block diagram of the printhead 26 and a power supply 201 portion of the printhead control circuit 28 of FIG. 1 according to the prior art. FIG. 2 comprises the printhead 26, the power supply 201, a power supply bus 203, a power return bus 205, and power supply connection terminals 224 and 226. The printhead 26 comprises a power supply line 220, resistive heat elements 207-1, 207-2, . . . , 207-N, switches 209-1, 209-2, . . . , 209-N, a power return line 222, latches 211-1, 211-2, . . . , 211-N, an N stage shift register 213, an enable line 228, a latch line 229, a data line 230 and a clock line 232. Each of resistive heat elements 207-1 through 207-N has first and second electrodes. Each of switches 209-1 through 209-N has first, second and control terminals and each of latches 211-1 through 211-N has an input terminal, an output terminal, a latch terminal, and an enable terminal.

The power supply 201 is coupled to a first end of the power supply bus 203 and to a first end of the power return bus 205. A second end of the power supply bus 203 is connected to the power supply line 220 in the printhead 26 through the power supply connection terminal 224 and a second end of the power return bus 205 is connected to the power return line 222 in the printhead 26 through the power supply connection terminal 226. The first electrode of each resistive heat element (e.g., 207-1 through 207-N) is connected to the power supply line 220. The second electrode of the resistive heat element 201-1 is connected to the first terminal of the switch 209-1. The second electrode of the resistive heat element 207-2 is connected to the first terminal of the switch 209-2 and the second electrode of the resistive heat element 207-N is connected to the first terminal of the switch 209-N. The second electrodes of the resistive heat elements 207-3 through 207-N-1 (not shown) are similarly connected to the first terminals of switches 209-3 through 209-N-1 (not shown). The second terminal of each of switches 209-1 through 209-N is connected to the power return line 222.

The control terminal of the switch 209-1 is coupled to the output terminal of the latch 211-1. The control terminal of the switch 209-2 is coupled to the output terminal of the latch 211-2 and the control terminal of the switch 209-N is coupled to the output terminal of the latch 211-N. The control terminals of switches 209-3 through 209-N-1 (not shown) are similarly coupled to the output terminals of the latches 211-3 through 211-N-1 (not shown). The input terminals of latches 211-1 through 211-N are coupled to successive stages of the shift register 213. The latch terminals of latches 211-1 through 211-N are coupled to the latch line 229 and the enable terminals of latches 211-1 through 211-N are coupled to the enable line 228. A first input of the shift register 213 is coupled to the data line 230 and a second input of the shift register 213 is coupled to the clock line 232.

In operation, m bit data codes (e.g., m=8 bits) corresponding to the image to be printed are stored in the printhead control circuit 28. The data codes are used to form a sequence of data bits which are transferred from the printhead control circuit 28 to the printhead 26 to energize the printhead heat elements 207-1 through 207-N. Each printhead heat element is energized by the number of data bits needed to produce the print density required at the corresponding pixel. The number of data bits may vary from zero to 255 for an 8 bit data code. The data bits DATA are serially shifted into the shift register 213 of FIG. 2 via the data line 230. A clock source (not shown) in the printhead control circuit 28 of a design well known in the art supplies signals CLK to the shift register 213 on the line 232 to control the shifting of the data bits into the shift register at a predetermined rate. When the N data bits are received by the shift register 213, they are transferred to the latches 211-1 through 211-N by the latch pulse LA from line 229 in a manner well known in the art. Switches 209-1 through 209-N are closed responsive to the data bits in the corresponding latches and an enable pulse EN on the enable terminals of the latches 211-1 through 211-N so that the heat elements 207-1 through 207-N selectively receive current from the power line 220. The shift register 213 successively receives 256 sets of data bits which control the printhead heat elements 207-1 through 207-N so that the print density at each pixel of a print line corresponds to the data code stored in the printhead control circuit 28 for that pixel.

The data bits in the latches 211-1 through 211-N and the enable pulses EN control the energy developed in the heat elements 207-1 through 207-N, respectively, and thereby determine the densities of the pixels of the print line. For example, the latch 211-1 controls the switch 209-1 so that a number of predetermined width pulses corresponding to the data code in the printhead control circuit 28 are coupled to the control terminal of the switch 209-1. The switch 209-1 is closed in response to the enable pulse EN and the state of the latch 211-1. When the data bit in the latch is a one, a predetermined width enable pulse EN closes the switch 209-1. In this way the heat element 207-1 is energized by the power supply 201 in accordance with the density defined by the image pixel data code in the printhead control circuit 28. In like manner, latches 211-2 through 211-N control the operations of switches 209-2 through 209-N to determine the heat generated by heat elements 207-2 through 207-N, respectively.

Figure 8:
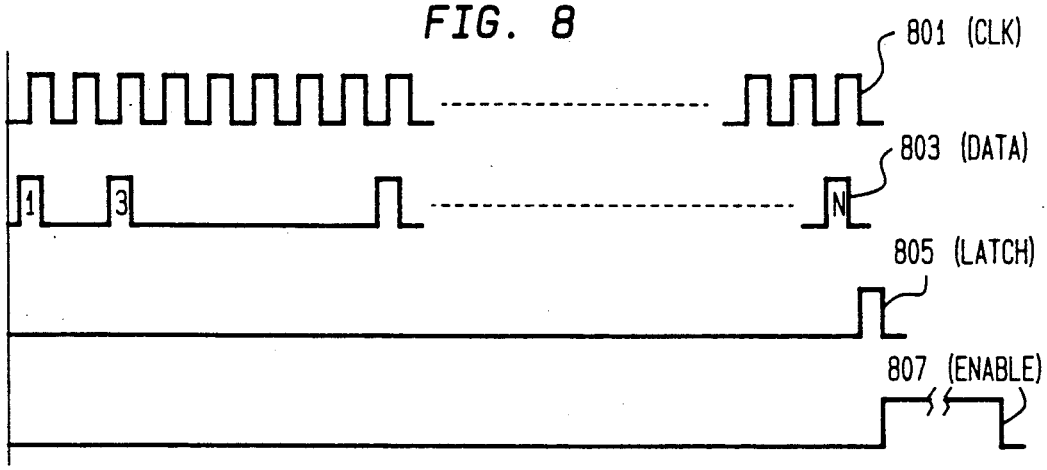
FIG. 8 shows waveforms illustrating data bit timing in the circuits of FIGS. 2, 3, 6 and 7.

Referring now to FIG. 8, there are shown pulse waveforms (volts) as a function of time (microseconds) illustrating the data bits supplied to the shift register 213, the clock signals used to insert the data bits into the shift register 213, the latch pulse used to insert the data bits into the latches 211-1 through 211-N, and the enable pulse used to transfer the data bits in the latches 211-1 through 211-N to control switches 209-1 through 209-N, respectively. For purposes of illustration, the magnitudes of the waveforms are shown as uniform. A waveform 801 shows the clock pulses CLK on the line 22 which control the insertion of data bits into the shift register 213. A waveform 803 shows a portion of the data bit stream DATA on the line 230 corresponding to the data bits for one of the 256 sets of data bits transferred to the shift register 213 for a print line. A waveform 805 shows the latch pulse used to insert the set of data bits shown in the waveform 803 into the latches 211-1 through 211-N. A waveform 807 shows an enable pulse EN that transfers the data bits in the latches 211-1 through 211-N to the control inputs of the switches 209-1 through 209-N.

A latch pulse occurs at the end of the transfer of each set of data bits into the shift register 213. The data stream DATA on the line 230 shown in waveform 803 is shifted into the shift register 213 by clock signals CLK shown in waveform 801 so that each data bit is positioned to control a specified heat element. A data bit may be a zero (i.e., low level) bit or a one (i.e., high level) bit. The heat elements 207-1 through 207-N are energized by data bits that are ones. For example, the data bit labeled 1 of the waveform 803 (a one data bit) is positioned so that it is transferred to the latch 211-1 when the N data bit set for a print line are aligned in the shift register 213. The data bit labeled N (a one data bit) is positioned so that it is transferred to the latch 211-N. In response to a latch pulse LA on the line 229, a one data bit is transferred from the shift register 213 into the latch 211-1 and the one data bit N is transferred into the latch 211-N. The enable pulse EN then provides a predetermined width pulse to the control input of each switch of switches 209-1 through 209-N for each latch that stores a one data bit. The data bits in the latches 211-1 and 211-N cause predetermined width pulses to be applied to the switches 209-1 and 209-N so that the heat energy in the corresponding heat elements 207-1 and 207-N is precisely controlled.

As is readily seen, the number of heat elements selected for each print line varies in accordance with the data supplied to the printhead 26. Referring again to FIG. 2, all, some, or none of the heat elements 207-1 through 207-N may be selected concurrently. Each selected resistive heat element is coupled to the power supply 201 through the power supply bus 203, the connection terminal 224, the power supply line 220, the power return line 222, the connection terminal 226, and the power return bus 205. Assume for purposes of illustration that the power supply 201 is well regulated. Voltage sense circuitry may be added as is well known in the art to compensate for the voltage drops in the power supply bus 203 and the power return bus 205. Consequently, the voltage between connection terminals 224 and 226 in FIG. 2 remains constant independent of the number of selected heat elements.

The resistances of the connection terminals 224 and 226, the power supply line 220, the power return line 222 and intermediate wiring to the heat elements 207-1 through 207-N in the printhead cause the voltage between the first and second electrodes of the selected heat elements to vary as the current drawn by the printhead 26 changes. These resistances within the printhead form a "parasitic resistance" that reduces the energy supplied to the selected heat elements even though a well regulated power supply may be used. As more heat elements are selected for a print line, more current is drawn by the printhead 26 and the voltage drop across the "parasitic resistance" increases. The voltage across each selected heat element is thereby reduced as the number of selected heat elements increases. Since the energy supplied to a selected heat element (e.g., 207-1) is proportional to the square of the voltage thereacross, the heat generated in the selected heat element changes as a function of the number of selected heat elements and the print density produced varies accordingly.

Figure 9:
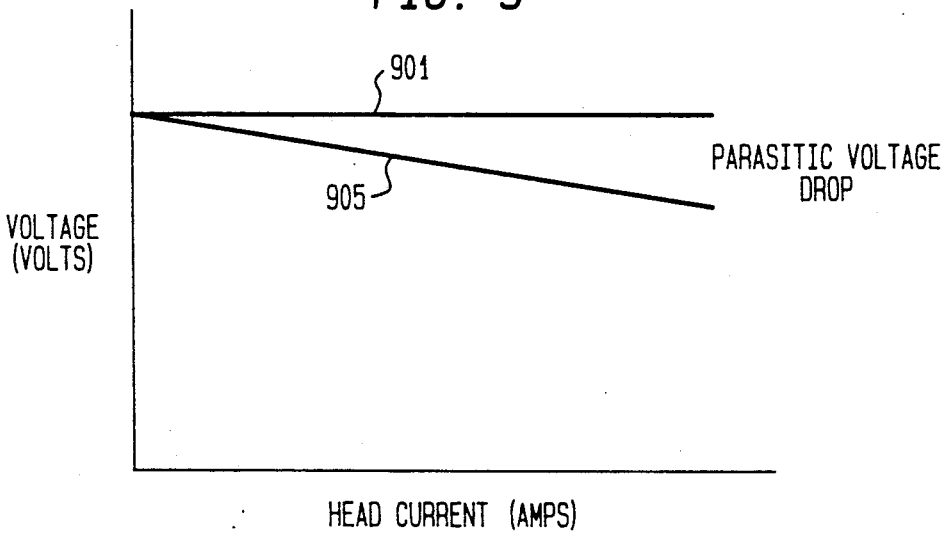
FIG. 9 is a graph illustrating the operation of the thermal printhead of FIG. 2.

Referring now to FIG. 9, there is shown a graph that illustrates the voltage variations resulting from the aforementioned "parasitic resistance" within the printhead 26. In FIG. 9, line 901 is a plot of the voltage (volts) at the output of the power supply 201 in volts as a function of the printhead current in amperes and line 905 is a plot of the voltage across a selected resistive heat element (volts) as a function of the printhead current (amperes). Since the power supply 201 is well regulated, the line 901 is horizontal corresponding to a constant voltage over the full range of the printhead current. The line 905, however, slopes downward as the printhead current increases due to the voltage drop in the "parasitic resistance". Consequently, there may be significant variation in the density of successive print lines. A print line that results from a relatively small number of selected heat elements has densities corresponding to a higher heat element voltage than a print line resulting from a large number of selected heat elements. Such variations in print density are generally not noticeable in text type prints where only black and white pixels are used. In image type prints, however, a tone scale having a range of gradations is used. In such type prints, density variations greater than one percent may be discernible.

Figure 3:
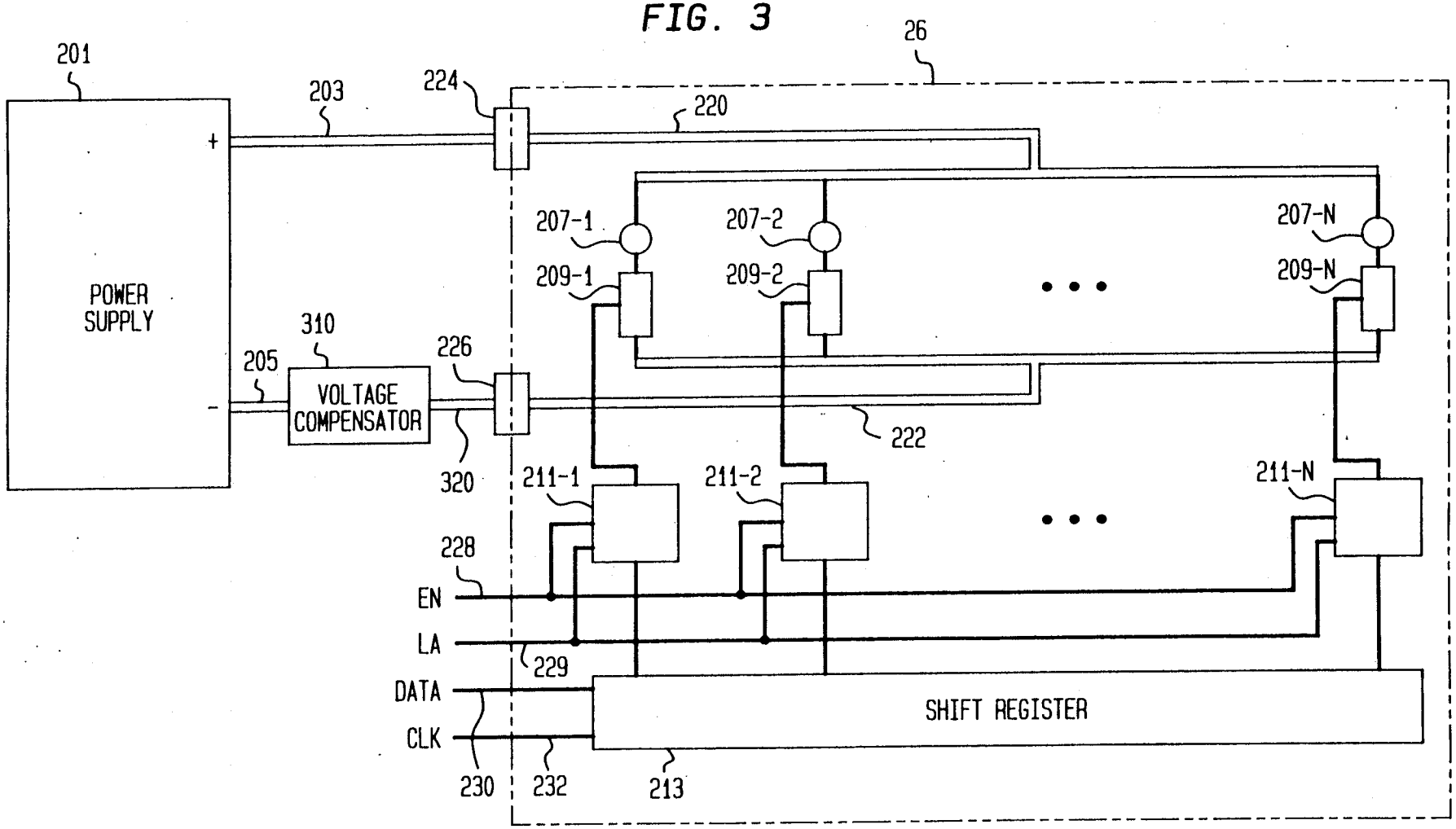
FIG. 3 is a general block diagram of a voltage compensation thermal printhead circuit embodiment in accordance with the present invention.

Referring now to FIG. 3, there is shown a block diagram of a voltage compensated thermal printhead power supply arrangement in accordance with the present invention. The voltage compensated thermal printhead power supply arrangement of FIG. 3 comprises the printhead 26, the power supply 201, and a voltage compensator 310. The printhead 26 and the power supply 201 are the same as shown in FIG. 2. The printhead 26 is connected as described with respect to FIG. 2. The power supply bus 203 in FIG. 3 is connected between a positive output of the power supply 201 and the connection terminal 224. The power return bus 205 in FIG. 3 is connected between a negative output of the power supply 201 and a first terminal of the voltage compensator 310. A second terminal of the voltage compensator 310 is coupled to the connection terminal 226 via the bus 320.

In FIG. 3, data bits are shifted into the shift register 213 and transferred to the latches 211-1 through 211-N as previously described with respect to FIG. 2. The voltage compensator 310 is adapted to sense the number of selected heat elements in the printhead 26 and to modify the voltage applied between connection terminals 224 and 226 of the printhead so that the energy supplied to each printhead heat element is maintained at a constant level substantially independent of the number of selected heat elements. In this way, the aforementioned "parasitic resistance" voltage drop is offset to prevent variations of print density.

Figure 10:
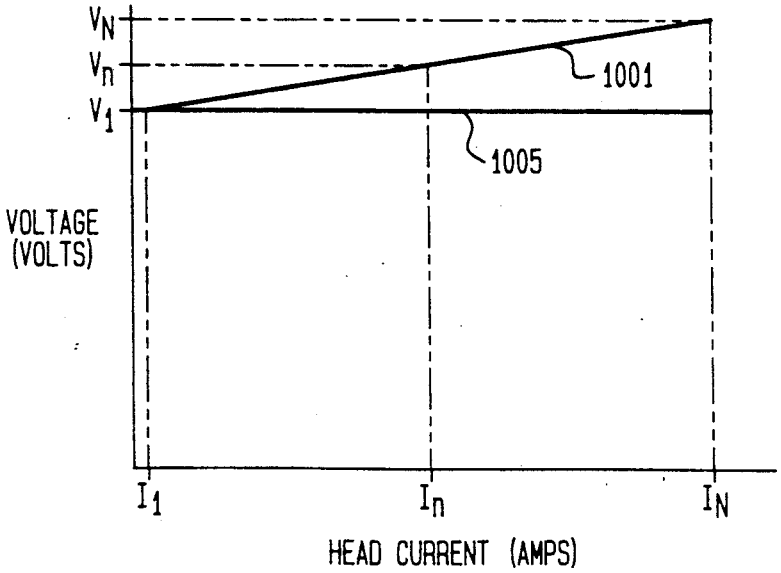
FIG. 10 is a graph illustrating the operation of the thermal printheads of FIGS. 3 through 7.

Referring now to FIG. 10, there is shown a graph that illustrates the voltage between the connection terminals 224 and 226 of FIG. 3 and the voltage across the selected heat elements in the printhead 26 of FIG. 3 as a function of the current drawn by the printhead. In FIG. 10, a line 1001 is a plot of the voltage across connection terminals 224 and 226 of FIG. 3 in volts as a function of the printhead current in amperes in the power supply bus 203 and a line 1005 is a plot of the voltage (volts) across a selected resistive heat element as a function of the printhead current (amperes) in the power supply bus 203 of FIG. 3.

As previously described with respect to FIG. 2, the power supply 201 in FIG. 3 may be well regulated voltage source that provides a substantially constant voltage equal to that required by the selected heat elements for normal density printing. In the event that only one heat element (e.g., 207-1) is selected for a print line, the printhead current is relatively low (II in FIG. 10) and the voltage across the connection terminals 224 and 226 is substantially the same as the voltage across the selected heat element (V1 in FIG. 10). If several heat elements are selected (e.g., 207-1 through 207-n) so as to increase the current in the power supply bus 203 to In, the voltage across the voltage compensator 310 decreases so that the voltage across connection terminals 224 and 226 (waveform 1001) is sufficient (Vn in FIG. 10) to maintain the voltage V1 across the selected heat elements. When all heat elements are selected, the printhead current increases to IN. The voltage across the voltage compensator 310 is adjusted to set the voltage between connection terminals 224 and 226 in FIG. 3 at VN so that the voltage V1 is maintained across the heat elements 207-1 through 207-N independent of the number of selected heat elements. The voltage compensator 310 is shown coupled to the power return bus 205. Alternatively, the voltage compensator 310 may be coupled to the power supply bus 203 without altering the operation of the compensation arrangement.

Figure 4:
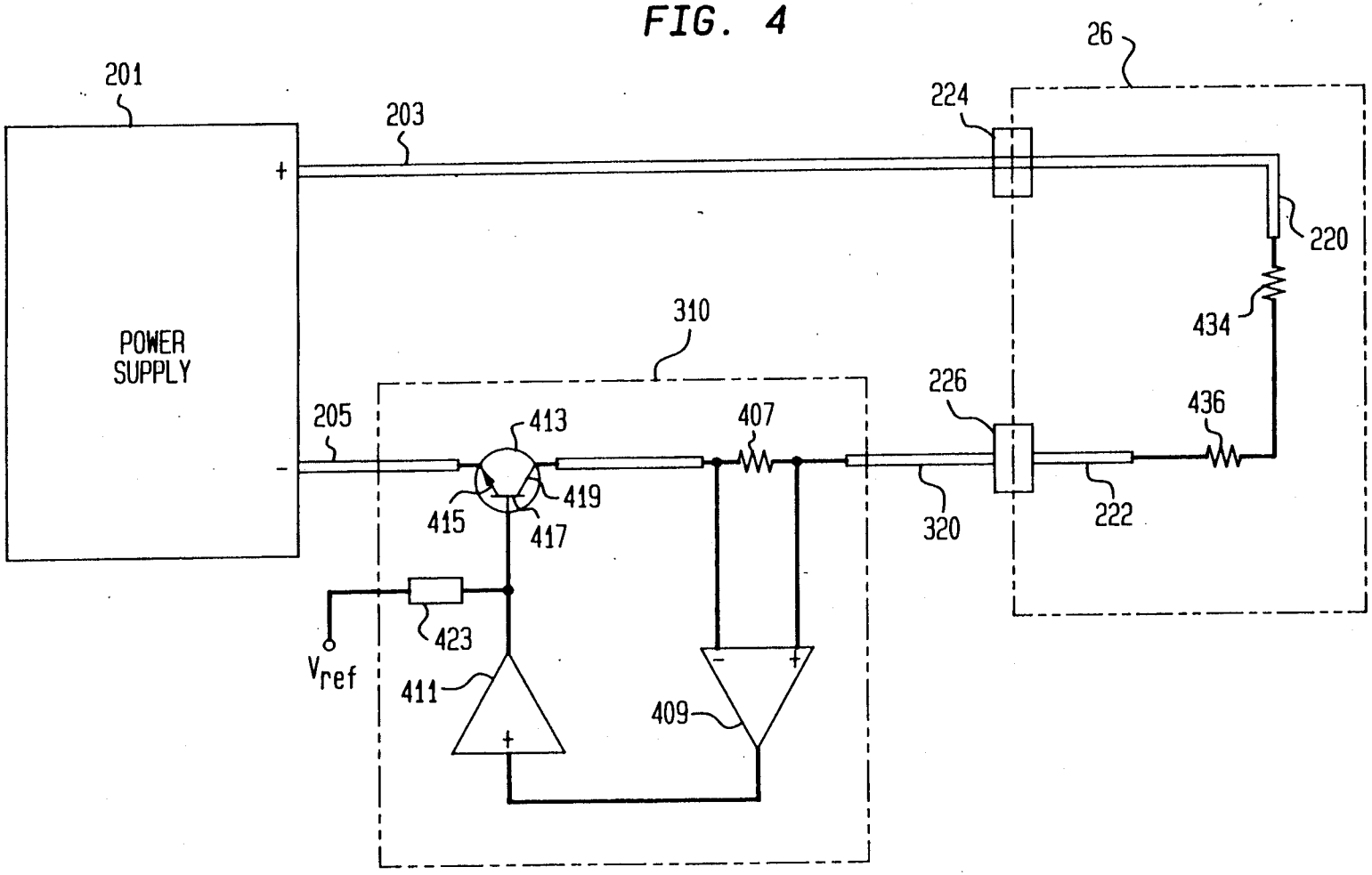
FIG. 4 is a schematic and block diagram of the thermal printhead circuit of FIG. 3 showing one type of voltage compensator in accordance with the present invention in greater detail.

Referring now to FIG. 4, there is shown a schematic and block diagram of the voltage compensated thermal-printhead power supply arrangement of FIG. 3 in accordance with the invention in which one type of voltage compensation circuit is illustrated. The voltage compensated thermal printhead power supply arrangement of FIG. 4 comprises the power supply 201, the power supply bus 203, the printhead 26, the voltage compensator 310 shown as a dashed line rectangle, the power return bus 205, the power return bus 320, and connection terminals 224 and 226. The printhead 26 in FIG. 4 is the same as that of FIG. 2 or FIG. 3 but is shown schematically as two resistances 434 and 436 connected in series for purposes of illustration. The resistance 434 represents the combined resistances of the selected heat elements of the printhead 26 and the resistance 436 represents the "parasitic resistance" noted with respect to FIG. 3. The "parasitic resistance" includes the resistances of the connection terminals 224 and 226, the power supply line 220, the power return line 222 and intermediate wiring to the selected heat elements in the printhead. As described with respect to FIG. 3, the power supply bus 203 in FIG. 4 is connected between the positive output of the power supply 201 and the connection terminal 224. The power return bus 205 is connected between the negative output of the power supply 201 and a terminal of the voltage compensator 310. The voltage compensator 310 is coupled to the connection terminal 226 via the return bus 320. Resistances 434 and 436 are connected in series between connection terminals 224 and 226.

The voltage compensator 310 in FIG. 4 comprises an n-p-n transistor 413 having an emitter 415, a base 417 and a collector 419, a resistor 407, a bias network 423, a differential amplifier 409 and a non-inverting amplifier 411. The emitter 415 of the transistor 413 is coupled to the power supply bus 205. The base 417 of the transistor 413 is coupled to an output of the amplifier 411 and to a first terminal of the bias network 423. A second terminal of the bias network 423 is connected to a reference potential Vref. The collector 419 of the transistor 413 is coupled to an inverting input of the differential amplifier 409 and to a first terminal of the resistor 407. A second terminal of the resistor 407 is coupled to a non-inverting input of the differential amplifier 409 and to the bus 320. An output of the amplifier 409 is coupled to an input of the non-inverting amplifier 411.

Assume for purposes of illustration that the voltage across a selected heat element in the printhead 26 for proper heat generation is Vh and that the voltage from the power supply 201 is Vo. To provide the voltage characteristic illustrated in FIG. 10, the transistor 413 is biased close to saturation by the bias network 423 so that voltage between connection terminals 224 and 226 (i.e., the power supply output voltage Vo less the emitter-collector voltage Vt of transistor 413 less the voltage drop across the resistor 407) is equal to the prescribed heat element voltage Vh when one heat element is selected. As a greater number of heat elements is selected, the current through the resistor 407 increases and the voltage across the resistor 407 becomes larger. In this way, the number of selected heat elements is sensed. The value of the resistor 407 is generally very low (e.g., in the order of milliohms) and the voltage thereacross is relative small. The voltage across the resistor 407 is amplified in the differential amplifier 409 so that the voltage at the output thereof becomes more positive as the current across the resistor 407 increases. The output of the non-inverting amplifier 411 is coupled to the base 417 of the transistor 413 and is effective to drive the transistor 413 further toward saturation as the voltage across the resistor 407 increases. The emitter-collector voltage drop Vt of the transistor 413 decreases as the current through the resistor 407 becomes larger whereby the voltage across the printhead connection terminals 224 and 226 is increased. In this manner, the voltage across the connection terminals 224 and 226 of FIG. 4 follows the line 1001 in the graph of FIG. 10 and the voltage Vh across the resistance 434 (i.e., the selected printhead heat elements) is kept substantially constant. The n-p-n transistor 413 in series with the power return bus 205 in FIG. 4 may be replaced by a transistor in series with the power supply bus 203.

Figure 5:
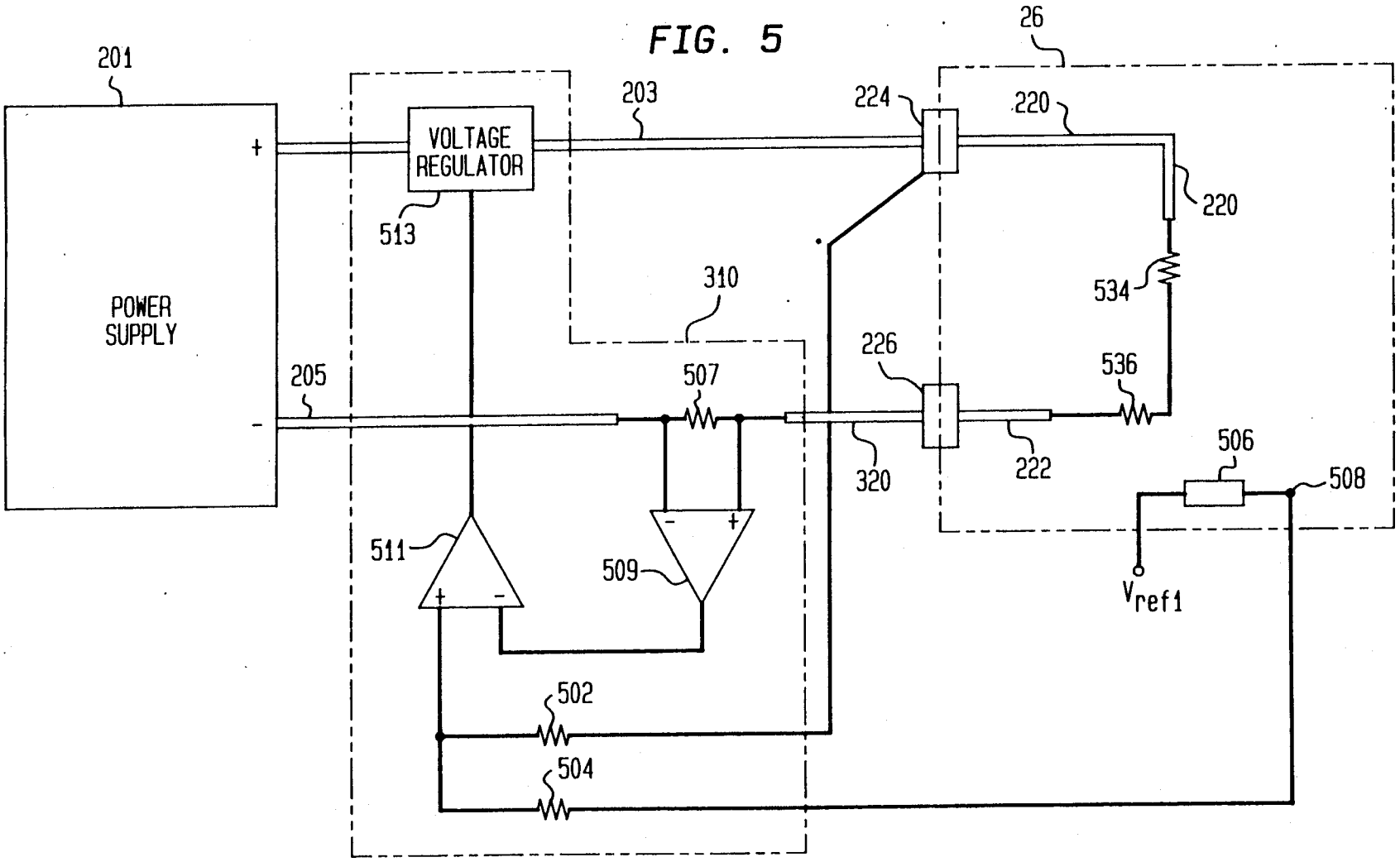
FIG. 5 is a schematic and block diagram of the thermal printhead arrangement showing another type of voltage compensator in accordance with the present invention.

Referring now to FIG. 5, there is shown a schematic and block diagram of the voltage compensation arrangement in accordance with the invention that is substantially the same as shown in FIG. 4 except that the adjustment of the voltage is performed in a voltage regulator that is coupled to the power supply. The voltage compensation arrangement of FIG. 5 comprises the power supply 201, the power supply bus 203, the printhead 26, the voltage compensator 310 shown within dashed lines, the power return bus 205, the power return bus 320, and connection terminals 224 and 226. The printhead 26 is represented as a resistance 534 connected in series with a resistance 536 and further comprises a temperature sensor 506. The voltage compensation arrangement of FIG. 5 is further modified to compensate for power bus voltage drops and temperature changes in the printhead. The printhead 26 and the power supply 501 are connected substantially as described with respect the printhead 26 in FIG. 4. As in FIG. 4, the resistance 534 represents the combined resistances of the selected printhead heat elements and resistance 536 represents the "parasitic resistance" comprising the resistances of the connection terminals 224 and 226, power supply and return lines 220 and 222 and intermediate wiring in the printhead.

The voltage compensator 310 in FIG. 5 comprises a resistor 507, differential amplifiers 509 and 511, resistors 502 and 504, and a voltage regulator 513. A first input of the voltage regulator 513 is coupled to the positive terminal of the power supply 201 and an output of the voltage regulator 513 is coupled to the power supply bus 203. The voltage regulator comprises a voltage sense arrangement (not shown) adapted to modify the output voltage of the power supply in response to the voltage applied to the sense input as is well known in the art. A first terminal of the resistor 507 is coupled to the power return bus 205 and to a first input of the amplifier 509. A second terminal of the resistor 507 is coupled to the connection terminal 226 via the return line 320 and to a second input of the amplifier 509. The connection terminal 224 in FIG. 5 is coupled to a first terminal of the resistor 502, and a second terminal of resistor 502 is coupled to a first input of the differential amplifier 511 and to a first terminal of the resistor 504. A second terminal of the resistor 504 is coupled to a terminal 508 of the temperature sensing device 506 (e.g., a thermistor) in the printhead 26. A second terminal of the thermal sensing device 506 is connected to a reference potential Vref1. An output of the differential amplifier 511 is coupled to a second input of the voltage regulator 513. A negative output of the power supply 201 is coupled to the power return bus 205.

In operation, the current flowing through the resistance 534 (i.e., the selected heat elements) passes through the resistor 507. The voltage drop across the resistor 507 is amplified by the differential amplifier 509 and coupled from the output of the amplifier 509 to an inverting input of the amplifier 511. The voltage at the output of the amplifier 509 is representative of the number of selected heat elements in the printhead 26. The voltage at the connection terminal 224 indicative of the voltage drop through the power supply bus 203 is coupled to a non-inverting input of the amplifier 511 through the resistor 502 and the voltage from the temperature sensing device 506 appearing at the terminal 508 is coupled to the non-inverting input of the amplifier 511 through the resistor 504.

The signals from the output of the amplifier 509 and resistors 502 and 504 are combined and amplified in the amplifier 511. The resultant signal appearing at the output of the amplifier 511 is coupled to a sense input of the voltage regulator 513. As a result, the voltage across the voltage regulator 513 is adjusted to account for changes in print density due to the varying number of selected heat elements, the voltage drop between the power supply and the connection terminal 224 and the temperature of the printhead. With regard to the varying number of selected printhead heat elements, the power supply voltage is modified in proportion to the voltage drop across the resistor 507. Thus, the voltage across the connection terminals 224 and 226 increases in proportion to the number of selected heat elements. In this way, the voltage across the selected heat elements is maintained at a predetermined value as illustrated in the line 1005 in the graph of FIG. 10. In addition to compensation for "parasitic resistance" drops in the printhead 26, any decrease in the voltage at the connection terminal 226 causes the power supply voltage to be increased and any increase in temperature detected by the temperature sensing device 506 causes the power supply voltage to decrease. The voltage across the connection terminals 224 and 226 in FIG. 3 provided by power supply 201 is modified by the operation of the voltage regulator 513 to maintain the selected heat element voltage at a value that is constant except for corrections due to temperature variations detected by the temperature sensitive device 506. While the voltage regulator 513 is shown as a separate circuit element of the voltage compensator 310 in FIG. 5 for purposes of illustration, it may be incorporated in the power supply 201 and serve the same function as is well known in the art.

Figure 6:
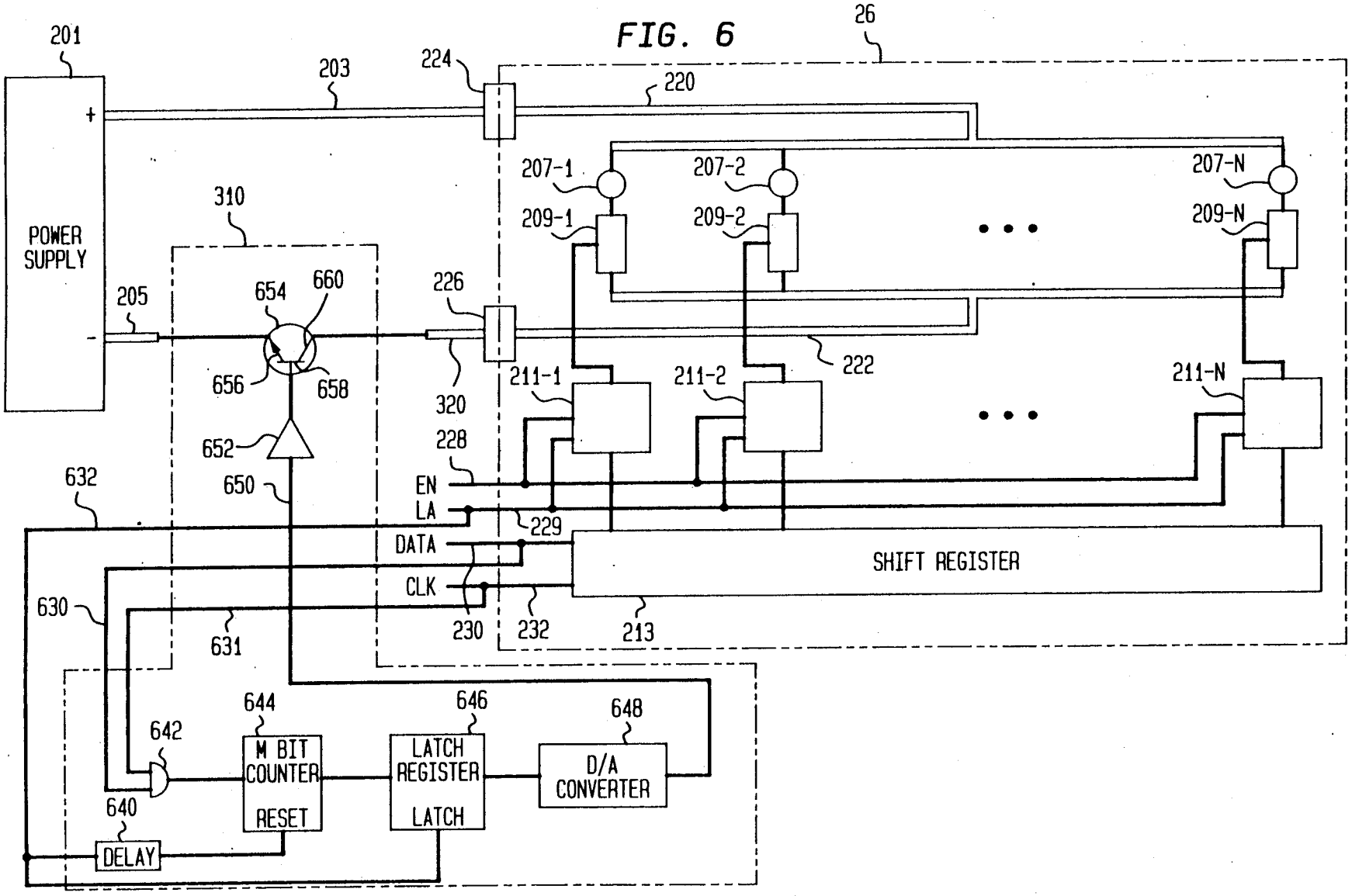
FIG. 6 is a schematic and block diagram of a thermal printhead circuit showing a voltage compensator utilizing a counter arrangement in accordance with the invention.

Referring now to FIG. 6, there is shown a schematic and block diagram of a voltage compensated thermal printhead arrangement utilizing a counter to sense the number of selected heat elements. The voltage compensated thermal printhead arrangement of FIG. 6 comprises the power supply 201, the power supply bus 203, the thermal printhead 26, power return buses 205 and 320, and the voltage compensator 310 shown within dashed lines. The printhead 26 and the power supply 201 in FIG. 6 are the same as described with respect to FIG. 2. The voltage compensator 310 in FIG. 6 comprises a delay element 640, an AND gate 642, an m bit counter 644, a latch register 646, a digital to analog (D/A) converter 648, a non-inverting amplifier 652, and an n-p-n transistor 654 having an emitter 656, a base 658 and a collector 660.

As described with respect to FIG. 3, the power bus 203 in FIG. 6 is connected between the positive output of the power supply 201 and the connection terminal 224. The power return bus 205 is connected between the negative output of the power supply 201 and a terminal of the voltage compensator 310. The voltage compensator 310 is coupled to the connection terminal 226 via the bus 320. In the voltage compensator 310 of FIG. 6, a first input of the AND gate 642 is coupled to the data line 630. A second input of the AND gate 642 is coupled to the clock line 631. An output of the AND gate 642 is coupled to a count input of the m bit counter 644. An input of the delay 640 is coupled to the latch line 632. An output of the delay 640 is coupled to a reset input of the m bit counter 644 and to a latch input of the latch register 646. An output of the latch register 646 is coupled to an input of the digital to analog (D/A) converter 648 and an output of the digital to analog converter 648 is coupled to the input of the non-inverting amplifier 652 via line 650. An output of the non-inverting amplifier 652 is coupled to the base 658 of the transistor 654. The emitter 656 of the transistor 654 is coupled to a first end of the power return bus 205. A second end of the power return bus 205 is coupled to the negative output of the power supply 201. The collector 660 of the transistor 654 is coupled to a first end of the power return bus 320. A second end of the power return bus 320 is coupled to the connection terminal 226.

The operation of the shift register 213, the latches 211-1 through 211-N, switches 209-1 through 209-N and resistive heat elements 207-1 through 207-N in FIG. 6 are substantially as described with respect to FIG. 2. When each sequence of data bits of a print line is received by the shift register 213, the data bits from the successive stages of the shift register are transferred to latches 211-1 through 211-N by the latching pulse LA. In response to the enable pulse EN for the print line, the switches 209-1 through 209-N having one data bits in the corresponding latches 211-1 through 211-N are closed for the predetermined time interval. The resistive heat elements are thereby selectively energized with the number of predetermined width pulses to produce the required print densities. The data bits on the data line 630 are also applied to the count input of the m bit counter 644 through the AND gate 642. As a result, the count at the end of each data bit transfer to the shift register 213 corresponds to the number of selected heat elements.

The latch pulse LA (waveform 805 in FIG. 8) which occurs after each set of data bits is transferred to the shift register 213 is applied to the input of the delay 640. At this time, the count of the m bit counter 644 corresponds to the number of selected heat elements in the printhead 26. The undelayed latch pulse latches the count of the counter 644 into the latch register 646 and the delayed latch pulse from the delay 640 resets the counter 644. The output of the latch register is coupled to the digital to analog (D/A) converter 648 wherein an analog signal corresponding to the number of selected heat elements is formed. The transistor 654 is initially biased to provide a prescribed voltage drop near saturation (e.g., 0.6 volts) when the signal from the digital to analog converter 648 is zero. When the count of selected heat elements is larger, the signal from the digital to analog converter 648 increases. The transistor 654 is driven further toward saturation and its emitter-collector voltage decreases. As a result, the voltage across connection terminals 224 and 226 increases to maintain the prescribed essentially equal voltage across the selected heat elements substantially constant independent of the number of selected heat elements.

Referring again to FIG. 10, the line 1001 represents the voltage across the connection terminals 224 and 226 in FIG. 6 which increases with the number of selected heat elements to compensate for the voltage drop across the "parasitic resistance". The line 1005 corresponds to the voltage across the first and second electrodes of the selected heat elements in FIG. 6 which remains substantially constant independent of the number of selected heat elements. While the heat element count arrangement including the counter 644 and the digital to analog converter 648 are components of the voltage compensator 310, it is to be understood the counter arrangement shown in FIG. 6 may be located in the printhead control circuit 28 of FIG. 1 or elsewhere and that the heat element count may be done by other arrangements well known in the art.

Figure 7:
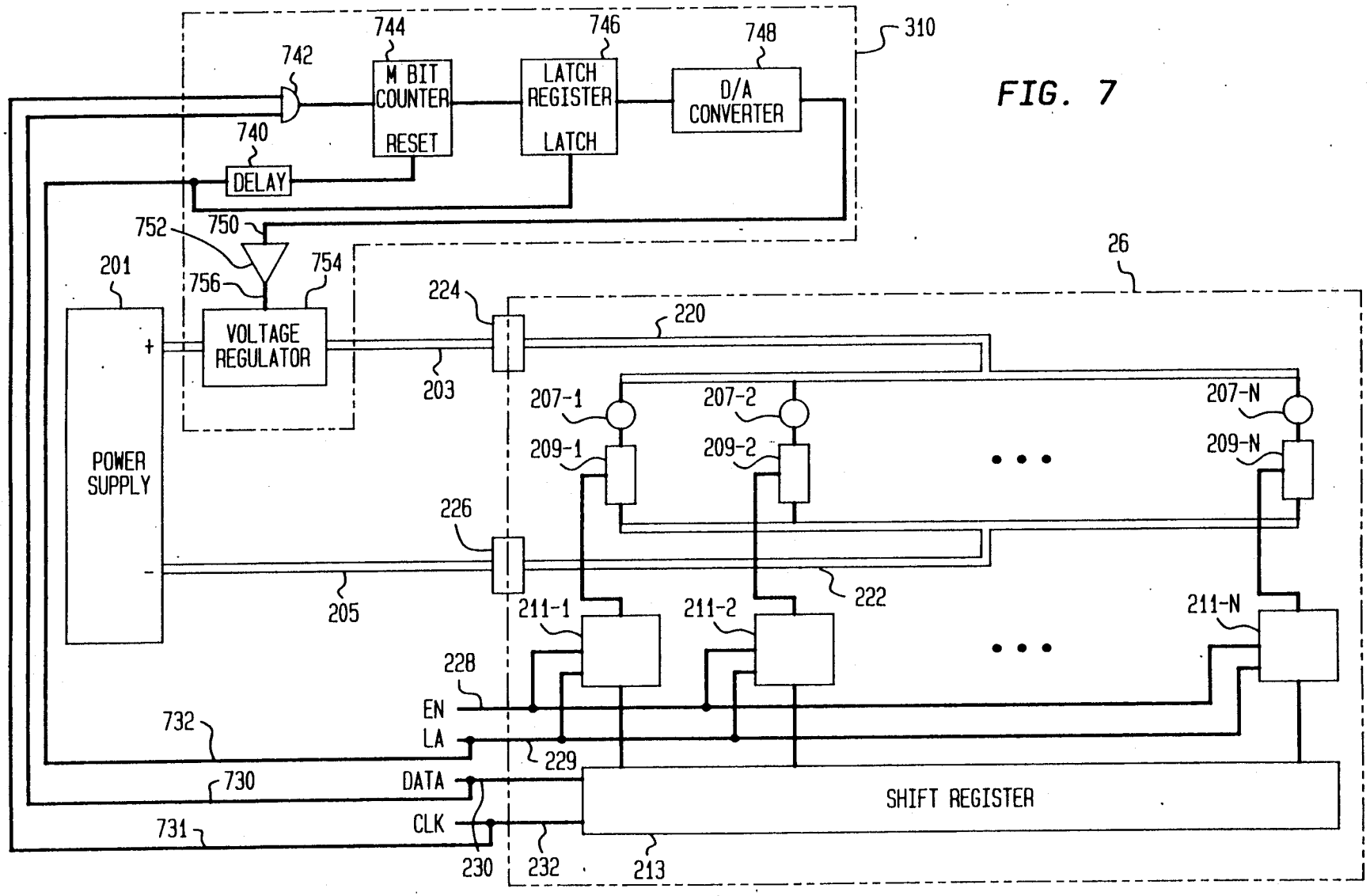
FIG. 7 is a schematic and block diagram of a thermal printhead circuit showing yet another counter type voltage compensation arrangement in accordance with the present invention.

Referring now to FIG. 7, there is shown a schematic and block diagram of a voltage compensation thermal printhead arrangement in accordance with the present invention that utilizes a counter arrangement and a voltage regulator. The voltage compensation thermal printhead arrangement of FIG. 7 comprises the power supply 201, the power supply bus 203, the printhead 26, the power return bus 205, and the voltage compensator 310 shown within the dashed lines. The power supply 201 and the printhead 26 in FIG. 7 are the same as shown in FIG. 6. The voltage compensator 310 in FIG. 7 comprises a delay element 740, an AND gate 742, an m bit counter 744, a latch register 746, a digital to analog (D/A) converter 748, a non-inverting amplifier 752, and a voltage regulator 754. In the voltage compensator 310 of FIG. 7, a first input of the AND gate 742 is coupled to the data line 730. A second input of the AND gate 642 is coupled to the clock line 731. An output of the AND gate 742 is coupled to a count input of the m bit counter 744. An input of the delay 740 is coupled to the latch line 732 and to a latch input of the latch register 746. An output of the delay 740 is coupled to a reset input of the m bit counter 744. An output of the latch register 746 is coupled to an input of the digital to analog (D/A) converter 748 and an output of the digital to analog converter 748 is coupled to the input of the non-inverting amplifier 752 via a line 750. A first terminal of the voltage regulator 754 is coupled to an output of the amplifier 752 via a line 756. A second terminal of the voltage regulator 754 is coupled to the positive output of the power supply 201 and a third terminal is coupled to the power supply bus 203.

The operation of the shift register 213, the latches 211-1 through 211-N, switches 209-1 through 209-N, resistive heat elements 207-1 through 207-N, the delay 740, the AND gate 742, the m bit counter 744, the latch register 746, and the digital to analog converter 748 are substantially as described with respect to the corresponding elements of FIG. 6. The analog signal corresponding to the count of the counter 744 is supplied to the input of the non-inverting amplifier 752 via the line 750 and the output of the amplifier 752 is applied to the voltage regulator 754 via the line 756. With one heat element selected, the signal at the output of the amplifier 752 causes the voltage regulator 754 to maintain the voltage at the connection terminal 224 so that the voltage across the selected heat element is the prescribed voltage Vh. Selection of more heat elements increases the count of the counter 746 and raises the analog signal at the output of the amplifier 752. The increased analog signal at the output of the amplifier 752 reduces the voltage across the voltage regulator 754 so that the voltage Vh across the selected heat elements remains substantially constant.

As illustrated in the graph of FIG. 10, the voltage across connection terminals 224 and 226 in FIG. 7 (line 1001) is larger as the number of selected heat elements increases. In this way, compensation is provided for the voltage drop in the "parasitic resistance" in the printhead 26 including the resistances of connection terminals 224 and 226, the power supply line 220, the power return line 222 and the intermediate wiring between the power supply and return lines 220 and 222 and the first and second electrodes of the heat elements 207-1 through 207-N. The increased voltage across connection terminals 224 and 226 is controlled so that the voltage Vh across the selected heat elements (line 1005) remains substantially constant. While the voltage regulator 754 is shown as an element of the voltage compensator 310 in FIG. 7, it may alternatively be incorporated in the power supply 201 as is well known in the art.

It is to be understood that the specific embodiments described herein are intended merely to be illustrative of the spirit and scope of the invention. Modifications can readily be made by those skilled in the art consistent with the principles of this invention.

What is claimed is:

1. Thermal printing apparatus comprising:

a printhead comprising first and second power terminals and a plurality of heat elements coupled in parallel across the first and second terminals;

power supply means coupled to the first and second terminals of the printhead for supplying current to the heat elements;

control means coupled to the heating elements for selecting which of the heating elements receives the current supplied by the power supply means;

power sensing means coupled between the second power terminal of the printhead and the power supply means for sensing an instantaneous power demand of the printhead as the printhead is operating; and voltage controlling means responsive to the sensed instantaneous power demand of the printhead for directly controlling the voltage coupled to the first and second terminals of the printhead so as to maintain a prescribed essentially equal voltage across each of the selected heat elements.

2. The apparatus of claim 1 wherein the power sensing means for sensing the instantaneous power demand of the printhead comprises means for producing a signal representative of the current supplied from the power supply means to the printhead.

3. The apparatus of claim 2 wherein the means for controlling the voltage coupled to the first and second terminals of the printhead comprises means responsive to the signal representative of the current supplied by the power supply means to the selected heat elements for modifying the voltage coupled to the first and second terminals of the printhead so as to maintain the voltage across each of the selected heat elements at the prescribed essentially equal voltage independent of the number of selected heat elements.

4. The apparatus of claim 3 wherein:

the power supply means comprises means for producing a first voltage; and the means for modifying the voltage coupled to the printhead comprises means responsive to the signal representative of the current supplied by the power supply means to the printhead for adjusting the first voltage so as to maintain the prescribed essentially equal voltage across each of the selected heat elements in the printhead.

5. The apparatus of claim 3 wherein the means for modifying the voltage coupled to the printhead comprises voltage adjusting means coupled between the power supply means and the first and second terminals of the printhead for adjusting the voltage coupled to the printhead so as to maintain the same prescribed essentially equal voltage across each of the selected heat elements.

6. The apparatus of claim 5 wherein the voltage adjusting means comprises a semiconductor device having first, second and control electrodes, the first and second electrodes being coupled between the power supply means and one of the first and second terminals of the printhead and the control electrode being coupled to the means for producing a signal representative of the instantaneous power demand of the printhead.

7. The apparatus of claim 6 wherein the power sensing means for producing the signal representative of the instantaneous power demand of the printhead comprises:

resistive means coupled between the second electrode of the semiconductor device and the printhead; and amplifying means coupled between the resistive means and the control electrode of the semiconductor device.

8. The apparatus of claim 2 further comprising:

means for generating a signal representative of the temperature of the printhead; and the voltage controlling means comprises means jointly responsive to the signal representative of the current supplied from the power supply means to the printhead and the signal representative of the temperature of the printhead for modifying the voltage coupled to the first and second terminals of the printhead.

9. The apparatus of claim 1 wherein the voltage adjusting means is coupled between the second power terminal of the printhead and the power supply.

10. A thermal printer comprising:

a printhead comprising first and second power terminals, and a plurality of resistive heat elements, each resistive heat element having a first electrode and a second electrode;

a power supply having positive and negative terminals for supplying current to the printhead;

means for supplying data to the printhead;

a first bus for coupling the positive terminal of the power supply to the first terminal of the printhead;

means for coupling the first terminal of the printhead to the first electrode of each resistive heat element;

a second bus connected to the negative terminal of the power supply;

means coupled between the data supplying means and the second electrode of each resistive heat element responsive to the supplied data for selectively coupling the resistive heat elements to the second terminal of the printhead;

power sensing means coupled between the second terminal of the printhead and the second bus for sensing an instantaneous power demand of the printhead as the printhead is operating; and voltage adjusting means responsive to the sensed instantaneous power demand of the printhead for directly adjusting the voltage across the first and second terminals of the printhead to maintain a substantially constant voltage across the first and second electrodes of the selected resistive heat elements.

11. The apparatus of claim 10 wherein the power sensing means for sensing the instantaneous power demand of the printhead comprises means for producing a signal representative of the current in the second bus.

12. The apparatus of claim 11 wherein:

the voltage source comprises means for producing a first voltage between the positive and negative terminals thereof; and the voltage adjusting means comprises means responsive to the signal representative of the current in the second bus for modifying the first voltage to maintain the substantially constant voltage across the first and second electrodes of the selected heat elements of the printhead.

13. The apparatus of claim 11 further comprising:

means for generating a signal representative of the temperature of the printhead; and the voltage adjusting means comprises means jointly responsive to the signal representative of the current in the second bus and the signal representative of the temperature of the printhead for modifying the first voltage to control the voltage across the first and second terminals of the printhead.

14. The apparatus of claim 11 wherein the voltage adjusting means comprises a semiconductor device having first, second and control electrodes, the first and second electrodes being coupled in series with the second bus such that current flowing through the second bus flows through the semiconductor device, and the control electrode being coupled to the means for producing a signal representative of the current in the second bus.

15. The apparatus of claim 10 wherein the voltage adjusting means is coupled in one of the first and second buses.

16. Thermal printing apparatus comprising:

a printhead comprising first and second power terminals, and a row of heat elements, each heat element having first and second electrodes;

a power supply for supplying current to the printhead;

data supplying means;

means for coupling the printhead first terminal to the first electrode of each heat element;

means responsive to data from the data supplying means for selectively coupling the printhead second terminal to the second electrode of each heat element; and means for coupling the power supply to the first and second terminals of the printhead comprising:

power sensing means coupled between the second power terminal of the printhead and the power supply for sensing an instantaneous power demand of the printhead as the printhead is operating; and voltage adjusting means responsive to the sensed instantaneous power demand of the printhead for directly adjusting the voltage across the first and second terminals of the printhead so as to maintain the voltage between the first and second electrodes of the selected heat elements substantially constant independent of the number of selected heat elements and the instantaneous power demand of the printhead.

17. The thermal printing apparatus of claim 16 wherein the voltage adjusting means comprises means coupled between the power supply and one of the first and second terminals of the printhead responsive to a signal representative of the current supplied to the printhead for modifying the voltage applied between the first and second terminals of the printhead.

18. The apparatus of claim 17 further comprising:

means for generating a signal representative of the temperature of the printhead; and the voltage adjusting means comprises means jointly responsive to the current representative signal and the signal representative of the temperature of the printhead for modifying the voltage applied between the first and second terminals of the printhead.

19. The thermal printing apparatus of claim 16 wherein:

the power supply comprises means for generating a first voltage; and the voltage adjusting means comprises means coupled between the current representative signal forming means and the power supply responsive to the current representative signal for modifying the first voltage to maintain a substantially constant voltage across the first and second electrodes of the selected heat elements.

20. The apparatus of claim 16 wherein the voltage adjusting means is coupled between the power supply and one of the first and second power terminals of the printheat.

* * * * *